United States Patent [19]

Brown

[11] 4,348,818

[45] Sep. 14, 1982

[54] DEVICE FOR RECOVERING THE EXHAUST HEAT OF A CLOTHES DRYER

[76] Inventor: Robert C. Brown, P.O. Box 62, Stroud, Ontario, Canada, L0L 2M0

[21] Appl. No.: 171,900

[22] Filed: Jul. 24, 1980

[51] Int. Cl.[3] ..... F26B 11/04

[52] U.S. Cl. ..... 34/77; 34/86; 34/133

[58] Field of Search ..... 34/133, 35, 86, 76, 34/77, 235; 165/DIG. 2

[56] References Cited

U.S. PATENT DOCUMENTS

| | | | |
|---|---|---|---|
| 3,242,584 | 3/1966 | Jacobs | 34/76 |
| 3,999,304 | 12/1976 | Doty | 34/86 |
| 4,011,662 | 3/1977 | Davis | 34/86 |
| 4,034,482 | 7/1977 | Briscoe | 34/86 |
| 4,068,709 | 1/1978 | Schraud et al. | 34/86 |
| 4,095,349 | 6/1978 | Parker | 34/86 |
| 4,137,647 | 2/1979 | Clark, Jr. | 34/86 |
| 4,156,973 | 6/1979 | Bede | 34/86 |
| 4,227,315 | 10/1980 | Hight | 34/86 |

*Primary Examiner*—Larry I. Schwartz
*Attorney, Agent, or Firm*—Ridout & Maybee

[57] ABSTRACT

The invention provides a device for recovering heat from an appliance which provides an exhaust of warm moist air, comprising an appliance exhaust duct connectable between the exhaust outlet of the appliance and a condensing chamber which is adapted to be supported on an exterior wall of a building, the chamber having means for draining condensate therefrom, and a return duct adapted to allow recovered warm dry air to flow from the condensing chamber into the building.

11 Claims, 3 Drawing Figures

DEVICE FOR RECOVERING THE EXHAUST HEAT OF A CLOTHES DRYER

BACKGROUND OF THE INVENTION

The present invention relates to the utilization of the exhaust heat from a household clothes dryer or other appliance which provides an exhaust of warm moist air. The recovered heat may be used directly to heat a specific area of the house or in the case of a house having a forced air heating system, be introduced into the plenum of the furnace by way of the cool air return duct.

Generally, the excess heat generated by clothes dryers and like appliances is exhausted to the outside atmosphere, and thus wasted as a possible supplementary home heating source. Since the amount of heat recovered from a clothes dryer would be small compared to the overall heat requirement for a home during a heating season, a heat recovery device must be simple and easy to install in order to be economically justified.

The high moisture content of dryer exhaust air renders it undesirable for direct heating uses; however, a device comprising any of the commonly used condensers is likely to be too expensive to be commercially viable. While the recovered warm air does not have to be completely dry, a sufficient amount of moisture must be removed so that introduction of the recovered warm air into the house will not result in condensation, or undesirable fluctuations in the humidity of the interior atmosphere.

In addition to using the dried exhaust air directly for home heating, it would also be desirable to provide a device which introduces recovered warm air into a heat exchange relationship with the hot dryer exhaust thus further warming the recovered air prior to its use as a heating source.

Since the exhaust heat from the clothes dryer may not always be needed, means should be provided in a heat recover device to allow the exhaust alternatively to pass directly to the outside atmosphere.

BRIEF SUMMARY OF THE INVENTION

In accordance with the various features described above, the present invention provides a device for recovering heat from an appliance which provides an exhaust of warm moist air, comprising an appliance exhaust duct connectable between the exhaust outlet of the appliance and a condensing chamber which is supported on an exterior wall of a building, the condensing chamber being cooled by direct contact with the ambient exterior air and having means for draining condensate therefrom, and a return duct adapted to allow warm dry air to flow from the condensing chamber into the building.

In order to allow the dryer exhaust to vent to the outside atmosphere through the recovery device on those occasions when heat recovery is not desired, a door is provided on the condensing chamber which when opened disengages the device. Additionally, by placing the appliance exhaust duct within the return duct, the device is made more compact and the countercurrent flow of air in the return duct may be placed in an optimal heat exchange relationship with the warm appliance exhaust duct.

The device may be simply constructed and installed from readily available and inexpensive components. From the savings derivable from lower heating fuel costs, the present invention provides a device which can be easily justified economically.

BRIEF DESCRIPTION OF THE DRAWINGS

A detailed description of a preferred embodiment of the present invention is disclosed in conjunction with the accompanying drawings wherein.

DESCRIPTION OF THE PREFERRED EMBODIMENT

Figures 1, 2:
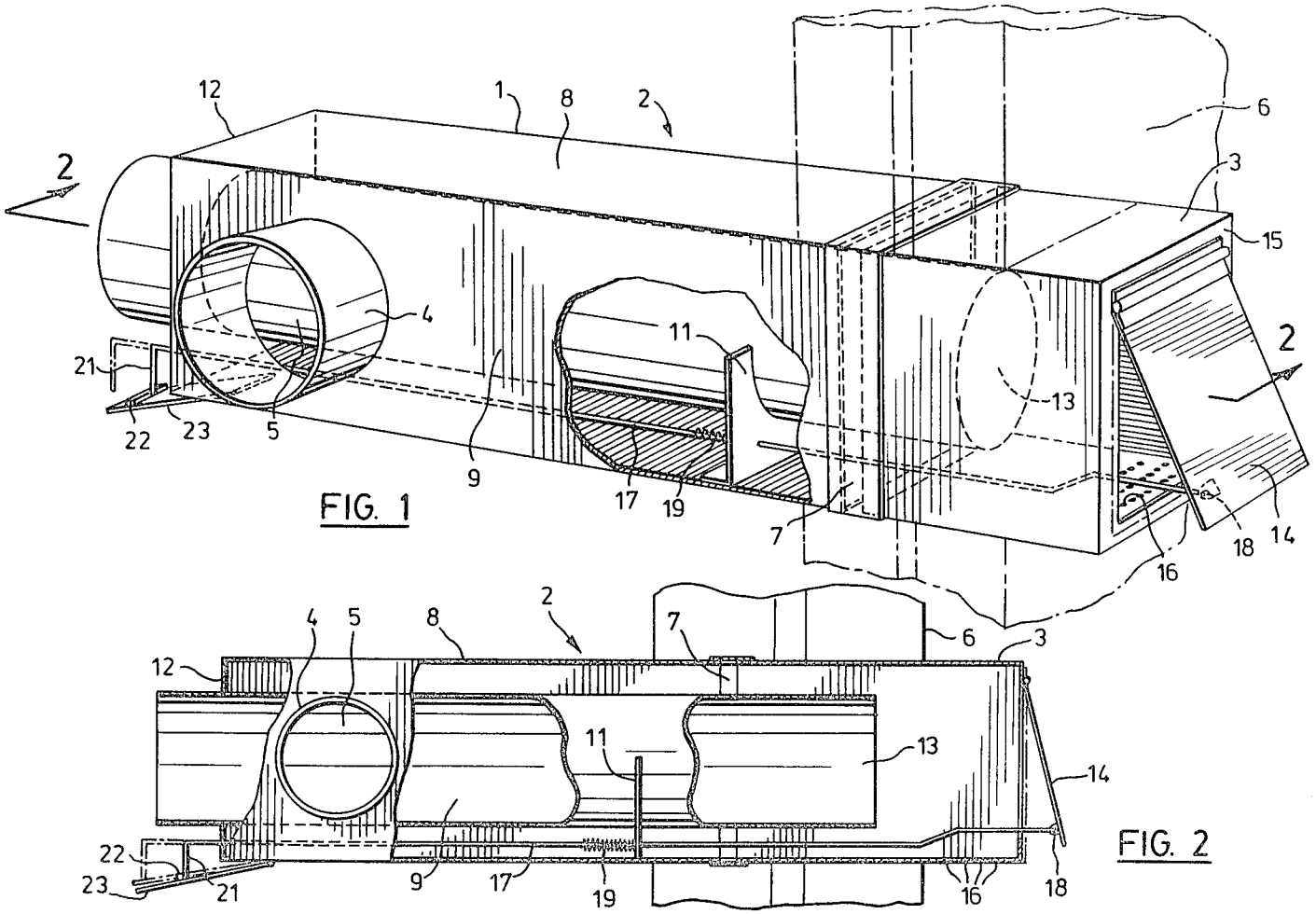
FIG. 1 is a perspective cutaway view of the device as installed.
FIG. 2 is a sectional elevational view of the device depicted in FIG. 1.

The outer shell 1 of the device 2 may be conveniently constructed from a commercially available square aluminum duct having a cross sectional dimension of approximately six inches per side. The shell 1 must be of sufficient length to extend through an exterior wall of a house by at least three inches, thereby providing a condensing chamber 3 positioned on the exterior of the building, and at the same time, the interior portion of the shell 1 must be of sufficient length to allow for convenient attachment of a flexible conduit to a sleeve 4 at an outlet 5.

The shell 1 is preferably divided into two pieces and inserted through a suitable hole in the exterior wall 6. A thermal break 7 made from vinyl or other suitable material is fitted between the two portions of the shell 1 which preferably are joined within the wall.

The portion of shell 1 supported on the exterior wall 6 comprises the condensing chamber 3, while the portion of shell 1 extending inwardly of the wall comprises a return duct 8. The return duct 8 contains an outlet 5, and an appliance exhaust duct 9 supported centrally in the return duct 8 by a saddle support 11. In the embodiment shown, the appliance exhaust duct 9 is approximately four inches in diameter and may be made of galvanized steel. The duct 9 extends through the interior end surface 12 of return duct 8, and is connectable to the exhaust outlet of a clothes dryer by a flexible conduit or other suitable means (not shown).

The exhaust duct 9 should extend through substantially the entire length of the return duct 8, however, the exhaust end 13 of the duct 9 should not extend into the condensing chamber 3, for this would greatly reduce the efficiency of the chamber 3. Thus, it is preferable that the exhaust duct 9 should extend through the return duct 8 to a point in the shell 1 located within the wall 6 slightly before the condensing chamber 3.

The condensing chamber 3 may be equipped with an outwardly opening hinged door 14 on its exterior end surface 15, and condensate may be drained therefrom by providing preferably several small holes 16 through the bottom surface of the chamber 3. The door 14 must remain closed during use of the device, but on those occasions, such as during the summer, when the recovery of heat from the dryer is not desired, the door 14 may be opened allowing the exhaust air to be dispersed into the atmosphere. For convenience, the door 14 may be equipped with remote control opening and closing means. One such means is shown in the figures as a rod 17, which passes through the length of the shell 1, and is attached to the door 14 at a swivel connection 18. In the embodiment depicted, a spring 19 provides a constant force on the rod 17 by pushing against the saddle support 11, thus constantly biasing the door 14 inwardly or toward the closed position. The door 14 may be propped open by pushing the handle 21 of the rod 17 inwardly and securing it against a restraining bar 22 located on a springhinged flap 23.

In operation of the device 2, the door 14 is closed and the exhaust air from the clothes dryer passes through the exhaust duct 9 and into the condensing chamber 3, where the moisture saturated exhaust air is slightly cooled causing condensation of water which collects on the cool inner surfaces of the condensing chamber 3 and drains out the holes 16. Not all of the moisture is removed from the exhaust air in the condensing chamber 3, but rather sufficient water is condensed in this manner so that the warm air recovered will not cause over-humidification when introduced into the interior of the house.

Figure 3:
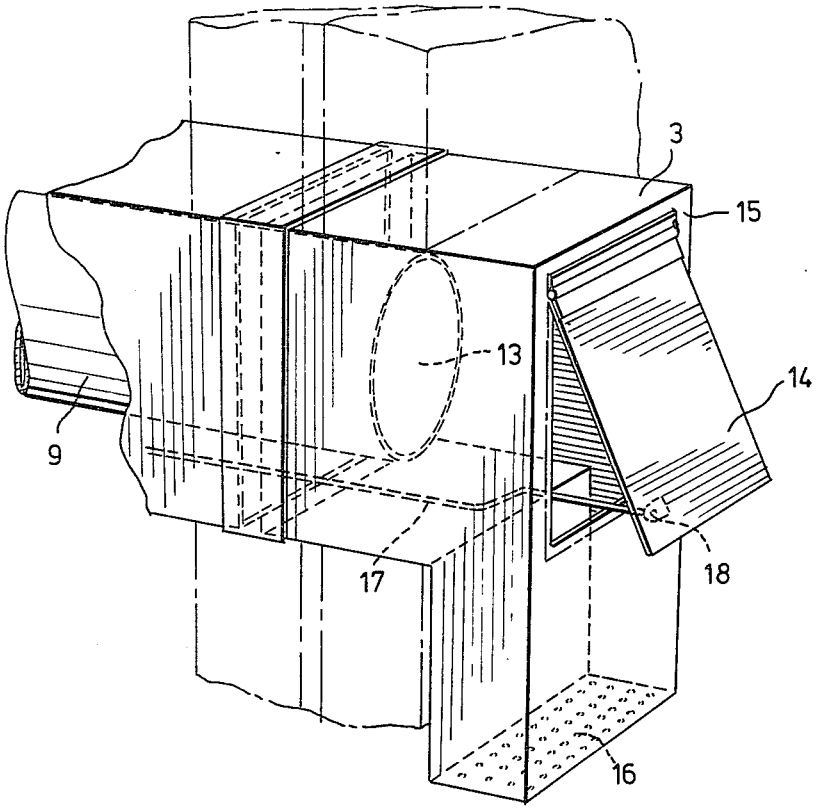
FIG. 3 is a perspective view of a variation of a portion of the preferred embodiment.

The efficiency of the condensing chamber 3 depends on the temperature and area of its inner surfaces. Thus, in locales where the winter temperatures are moderate, a larger condensing chamber may be desirable such as that shown in FIG. 3, or alternatively, condensing chamber 3 as shown in FIGS. 1 and 2 may extend a greater distance beyond the exterior of the wall 6. Clearly, there are many possible ways to enlarge condensing chamber 3, and the embodiment shown in FIG. 3 is only one example of a condensing chamber having a rectangular cross section with at least one dimension being greater than the corresponding dimension of the shell 1.

From the condensing chamber 3, the warm air, now having a much lower moisture content, flows into the return duct 8 where it comes into a heat exchange relationship with exhaust duct 9 thereby being heated further. The warm dry air leaves the device 2 at the outlet 5, which is preferably located near the interior end portion of the return duct 8 so that the recovered warm air is in a heat exchange relationship with the duct 9 for an optimal period.

The outlet 5 is adapted with a sheet metal sleeve 4 to facilitate connection of the device 2 to any suitable conduit for transporting the recovered warm air. In the case where a clothes dryer is located in the basement or lowest floor of the house, it may be desirable merely to allow the recovered warm air to be vented into the room containing the dryer, or to direct the warm air only to those rooms located on the lowest floor. Since the warm air will rise, some additional heating of the upper floors will occur indirectly as a result of this procedure.

If the house is heated by a forced air system, the recovered warm air may be dispersed throughout the house by directing the air flowing from the outlet 5 into the cool air intake of the furnace. The recovered warm air directed in this manner will flow by convection, or with the assistance of the circulating fan, to the plenum of the furnace and then through the various warm air ducts of the system.

I claim:

1. A device for recovering heat from an appliance located in a building which provides an exhaust of warm moist air, comprising an appliance exhaust duct connectable between the exhaust outlets of the appliance and a condensing chamber placed outside of the building, the chamber being cooled by direct contact with the ambient air external to the building and being capable of condensing moisture from the exhaust when the ambient air external to the building is sufficiently cool, means for draining condensate from the condensing chamber, and a return duct having an outlet to allow warm dry air to flow from the condensing chamber into the building.

2. A device as claimed in claim 1, wherein the appliance exhaust duct is provided lengthwise within the return duct.

3. A device as claimed in claim 1, wherein the outlet of the return duct is located so that the air flowing through the duct is placed in a heat exchange relationship with the appliance exhaust duct.

4. A device as claimed in claim 2, wherein the outlet of the return duct is located so that the air flow through the duct is placed in heat exchange relationship with the air flow through the appliance exhaust duct.

5. A device as claimed in claim 1, including a thermal break made from an insulating material for thermally insulating the material of the condensing chamber from the portion of the device intended to extend within the building.

6. A device as claimed in claim 1, wherein the condensing chamber includes adjustable means which may be opened to permit the exhaust to flow directly to the outside atmosphere.

7. A device as claimed in claim 6, wherein the adjustable means comprise a door which may be opened to vent the exhaust.

8. A device as claimed in claim 7, including remote control means for opening and closing the door on the condensing chamber, the means adapted to be operable from the interior of the building.

9. A device as claimed in claim 8, wherein the remote control means comprise a rod connected to the door and extending therefrom through the device, spring means acting on the rod biasing the door closed, and restraining means employable to over-ride the spring means thereby propping the door open.

10. A device as claimed in claim 1, wherein the means for draining condensate comprises a plurality of small holes through the bottom surface of the condensing chamber, the holes comprising a total area small enough so as not to substantially divert the flow of dry air back through the return duct.

11. A device for recovering heat exhausted from a clothes dryer, comprising a dryer exhaust duct, a condensing chamber, and a return duct, wherein the device is adapted to extend through an exterior wall of a building, the dryer exhaust duct being contained within the return duct, and being connectable between the exhaust outlet of the dryer and the condensing chamber; the condensing chamber being supported on the exterior wall and protruding outside of the building, the chamber being capable of condensing moisture from the exhaust when the exterior ambient air is sufficiently cool, the chamber having an outwardly opening remotely controllable hinged door on its forward surface, and a plurality of small drain holes through its bottom surface; and the return duct having means for supporting the exhaust duct therein, and having an outlet situated to allow warm dry air flowing from the condensing chamber to flow initially in heat exchange contact with the exhaust duct and then to flow from the device.

* * * * *